United States Patent [19]

von Conta

[11] Patent Number: 4,553,526

[45] Date of Patent: Nov. 19, 1985

[54] SECONDARY COMBUSTION SYSTEM FOR WOODBURNING STOVE

[75] Inventor: Peter E. W. von Conta, Montgomery Center, Vt.

[73] Assignee: The Hearthstone Corporation, Morrisville, Vt.

[21] Appl. No.: 584,082

[22] Filed: Feb. 27, 1984

[51] Int. Cl.[4] ..... F24C 1/16; F23B 5/00

[52] U.S. Cl. ..... 126/58; 110/213; 126/80; 126/83

[58] Field of Search ..... 126/58, 79, 80, 69, 126/75, 76, 77, 83, 290, 292, 297; 110/210, 211, 213, 203

[56] References Cited

U.S. PATENT DOCUMENTS

| | | | |
|---|---|---|---|
| 6,824 | 10/1849 | Cole | 126/58 |
| 1,819,119 | 8/1931 | Pykosz | 126/58 |
| 2,481,165 | 9/1949 | Landry | 126/76 |
| 3,543,700 | 12/1970 | Baigas, Jr. | 110/213 |
| 3,861,335 | 1/1975 | Przewalski | 110/213 |

*Primary Examiner*—Larry Jones

*Attorney, Agent, or Firm*—Prutzman, Kalb, Chilten & Alix

[57] ABSTRACT

A secondary combustion system for a woodburning stove employs a concave shaped screen for dispersing exhaust gases. A mixing chamber is formed in an insulated conduit between the concave screen and a second planar screen. The planar screen is perforated to form a random array of flaps which increase the turbulence of the exhaust stream so that a secondary combustion of the exhaust gases is produced.

20 Claims, 5 Drawing Figures

SECONDARY COMBUSTION SYSTEM FOR WOODBURNING STOVE

BACKGROUND OF THE INVENTION

This invention relates to a system for controlling the emission of pollutants from a woodburning stove. More particularly, this invention relates to a system for effecting the secondary combustion of exhaust gases generated by the primary combustion of combustibles in a woodburning stove.

The increased popularity of woodburning stoves and woodburning technology has been tempered by the increased focus on the potential adverse environmental effects from pollutants in the exhaust gases generated by woodburning stoves. A number of proposals have been advanced for reducing the pollutants generated by the woodburning process such as passing the exhaust gases through a catalytic combustor and/or various systems for effecting a secondary combustion of the exhaust gases. The necessity of improving the means for removing pollutants from the exhaust gases of woodburning stoves has been made evident by the increasing numbers of governmental regulations which legally restrict the atmospheric emissions of exhaust gases generated by a woodburning stove. The present invention is a new and improved secondary combustion system which is readily incorporated into a woodburning stove for combusting pollutants in the exhaust gases generated by the primary combustion.

BRIEF SUMMARY OF THE INVENTION

Briefly stated, the invention in a preferred form is an improved secondary combustion system for combusting the exhaust gases in a woodburning stove. The system employs an insulated conduit forming an insulated passageway having an intake opening from the firebox and an exit opening which leads to the exhaust opening of the stove. A dispersing member, which is preferably a generally concave shaped screen having a plurality of apertures, is interposed across the insulated passageway in the vicinity of the intake opening to disperse exhaust gases which are injected through the intake opening. A primary mixing chamber is formed in the exhaust passageway for mixing the dispersed exhaust gases. A restrictor member, which is preferably in the form of a substantially planar screen, is interposed across the passageway and spaced from the dispersing member to increase the exhaust velocity of the exhaust gases. A disruptor increases the turbulence in the exhaust gases exiting the restrictor member. A secondary combustion chamber is formed in the exhaust passageway between the restrictor member and the exit opening for combusting the exhaust gases. In a preferred form, the planar screen is a metallic sheet which is perforated to form apertures in a manner wherein perforated flap portions extend at an angle to the screen and are angularly oriented in a generally random fashion. The increased turbulence is created by the flap portions.

The apertures may be substantially uniformly dimensioned and uniformly distributed across the concave screen and the planar screen. The insulated exhaust passageway may have a longitudinally extending segment and a transversely extending segment. The dispersing member is located in the transverse segment.

A method in accordance with the invention for removing pollutants from an exiting exhaust stream of unconsumed oxygen and exhaust gases produced by the combustion of combustibles in a woodburning stove involves injecting the exhaust stream into an insulated passageway. The exhaust stream is dispersed into a plurality of small stream segments flowing in divergent directions by passing the stream through a dispersion screen interposed in the passageway. The dispersed gases are recombined and intermixed in the passageway to form a more homogeneous mixture of the uncomsumed oxygen and exhaust gases. The gas stream is accelerated by passing the stream through a second screen interposed in the passageway. A turbulence is imparted to the accelerated gas stream thereby combusting the exhaust gases in the presence of the unconsumed oxygen in the insulated passageway. The step of imparting the turbulence to the gas stream occurs in close proximity to the second screen. The method is performed without the introduction of a secondary supply of oxygen.

An object of the invention is to provide a new and improved secondary combustion system for combusting the exhaust gases produced by a woodburning stove.

Another object of the invention is to provide a new and improved secondary combustion system which is effective and may be efficiently incorporated into a woodburning stove.

A further object of the invention is to provide a new and improved secondary combustion system for a woodburning stove which system does not require catalytic combustor means.

Other objects and advantages of the invention will become apparent from the drawings and the specification.

DETAILED DESCRIPTION

Figure 1:
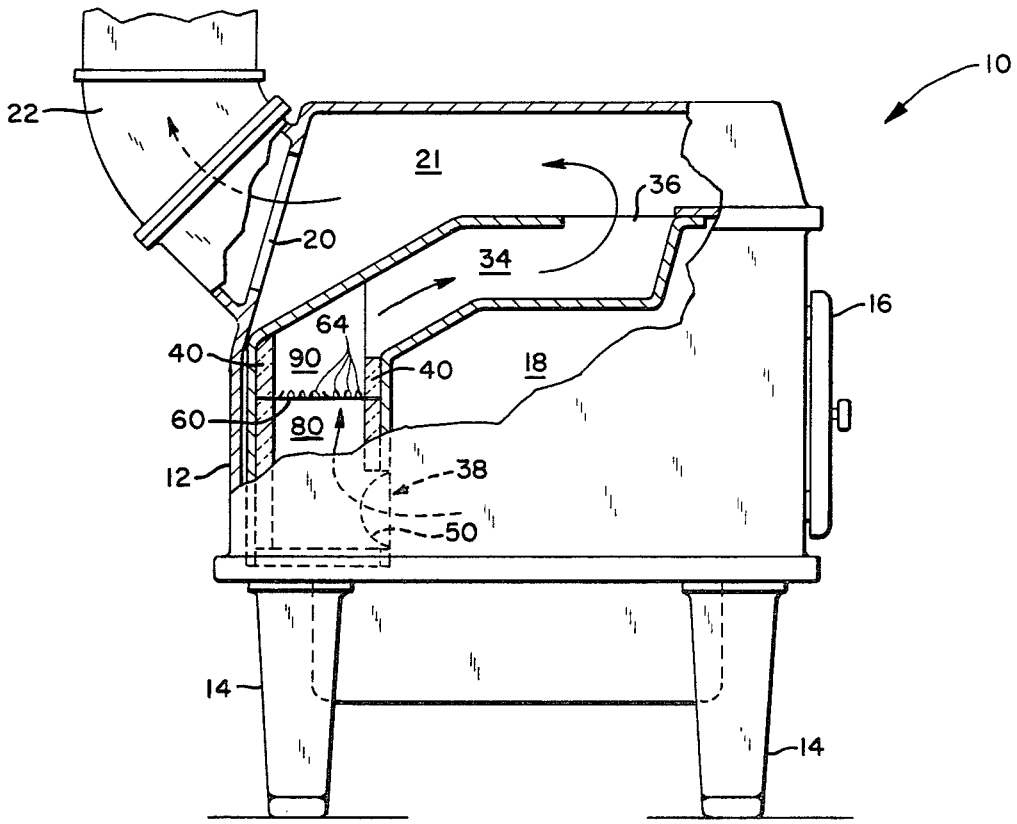
FIG. 1 is a side elevational view, partly broken away, of a woodburning stove incorporating a secondary combustion system of the present invention.

With reference to the drawing wherein like numerals represent like parts throughout the several figures, a woodburning stove incorporating a secondary combustion system of the present invention is generally designated by the numeral 10. Woodburning stove 10, excepting for the secondary combustion system hereinafter described, may assume any of a number of forms. Stove 10 generally includes a housing 12 of cast iron, soapstone, or other suitable material. Housing 12 is supported on four legs 14. A door 16 or pair of doors is located at the front of the housing for accessing a centrally located firebox chamber 18. An exhaust opening 20 at the upper rear of the housing leads from an exhaust plenum 21 and communicates with an exhaust flue 22 in a conventional manner. Stove 10 is preferably of a compact construction which provides for an efficient controlled combustion of fuel received in firebox chamber 18 and for the exhaust of exhaust gases to the exhaust flue 22.

Figure 2:
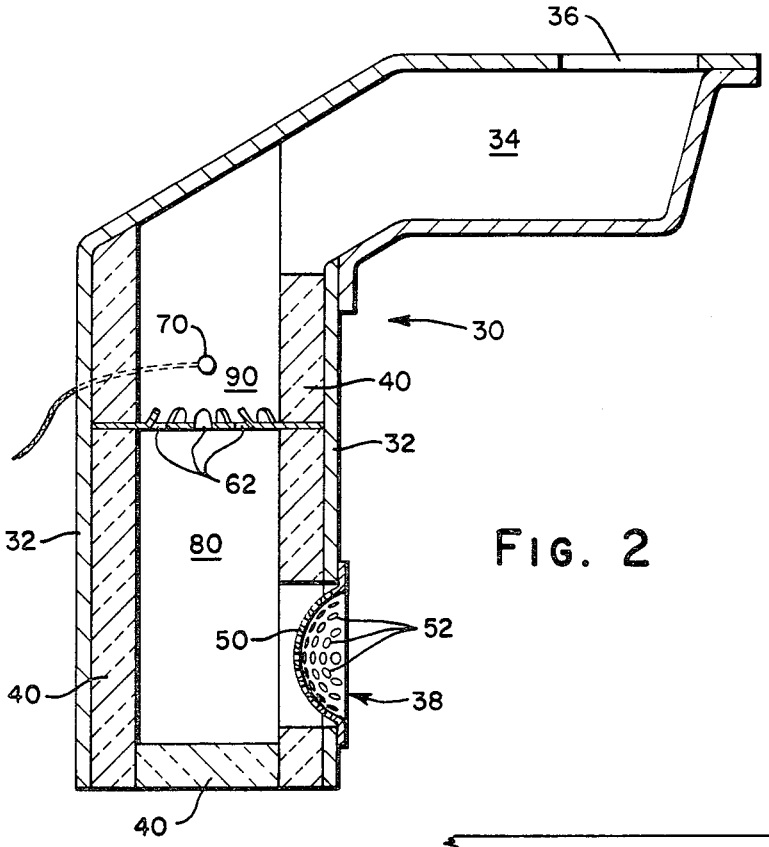
FIG. 2 is an enlarged fragmentary side sectional view of the secondary combustion system of FIG. 1.
Figure 3:
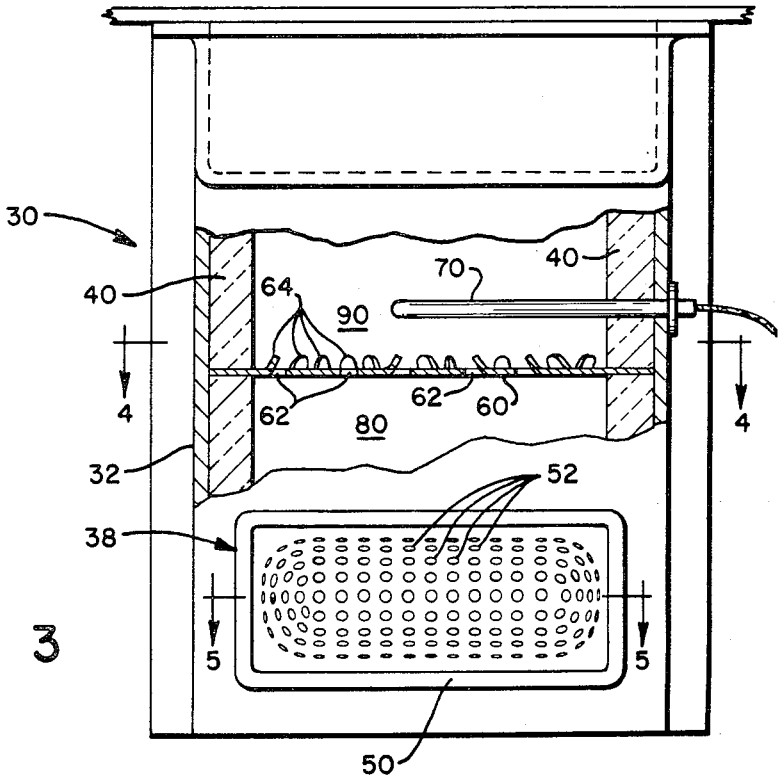
FIG. 3 is a front view, partly broken away, to form a sectional view of the secondary combustion system of FIG. 2.

With further reference to FIG. 2 and FIG. 3, a secondary combustion system in accordance with the invention is generally designated by the numeral 30. Secondary combustion system 30 is located at the central rear interior of stove 10. A conduit 32 extends vertically from the base of the housing interior to forwardly open into a generally transversely extending exhaust plenum 34. Exhaust plenum 34 forms at an upper forward portion an exhaust opening 36 which communicates via a second exhaust plenum 21 and exhaust opening 20 with exhaust flue 22. A forwardly protruding knob (not illustrated) may be employed for regulating a by-pass damper for controlling the smoke path into the secondary combustion system 30.

An intake opening 38 is formed at a lower front portion of conduit 32 for direct communication with the firebox chamber 18. A thermal insulation layer 40 is provided at the interior sides and the bottom of conduit 32 to form a vertically extending insulated passageway and a relatively short transverse passageway leading to intake opening 38. A alumina silica ceramic fiber board marketed by A.P. Green Refractories of Mexico, Miss. is a suitable material for insulation layer 40. Other refractory materials capable of maintaining a high temperature level within conduit 32 such as materials employed for lining kilns may also be suitable for insulation layer 40.

Figure 5:
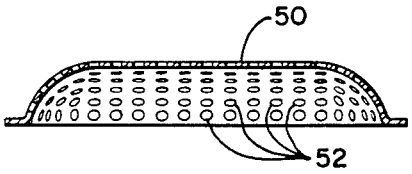
FIG. 5 is a sectional view of the secondary combustion system taken along the line 5—5 of FIG. 3.

A generally concave shaped screen 50 is mounted at intake opening 38. Screen 50 extends inwardly into the transverse passage formed at the lower portion of conduit 32. Concave screen 50 has a plurality of apertures 52 which are preferably of a uniform size and are uniformly distributed to form the screen as additionally illustrated in FIG. 5. In preferred form, concave screen 50 may be manufactured from a 300 Series stainless steel sheet and the apertures are on the order of $\frac{1}{4}$ inch in diameter.

Figure 4:
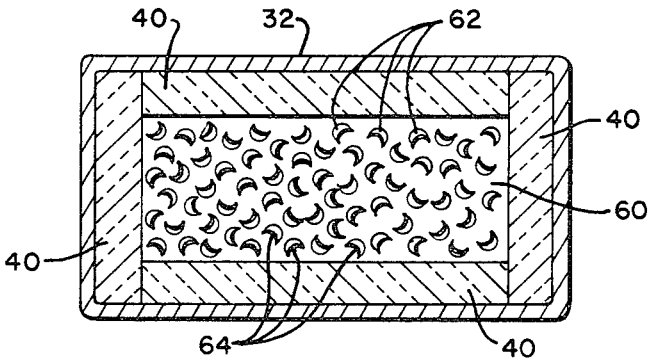
FIG. 4 is a sectional view of the secondary combustion system taken along the line 4—4 of FIG. 3.

A second substantially planar screen 60 extends transversely across the vertically extending insulated passageway at an intermediate vertical position. Planar screen 60 is preferably a sheet of stainless steel which has been perforated to form a plurality of uniformly dimensioned and substantially uniformly distributed apertures 62. The cutout portions which are displaced to form apertures 62 are bent upwardly or in a downstream direction at various angles to the plane of the sheet to form flaps 64. In addition, the flaps are angularly oriented in a generally random array to form an array of flaps 64 extending from the plane of screen 60 as illustrated in FIG. 4. The apertures 62 are preferably on the order of $\frac{1}{4}$ inch in diameter. Planar screen 60 and flaps 64 may also be formed by a casting process.

A high-temperature probe 70 may be positioned in the vertical passageway above planar screen 60. Probe 70 may be adapted for detecting relatively high temperatures and for providing an output signal to a controller for regulating an air inlet to the stove (not illustrated).

In operation, an exhaust stream of unconsumed oxygen and the exhaust gases from the combustion of the combustibles in the firebox chamber 18 flows through intake opening 38 in the general direction of the arrows in FIG. 1. The exhaust stream encounters the concave screen 50 and is propelled through the apertures 52. Concave screen 50 functions as a dispersing means to disperse the exhaust stream into a plurality of small stream segments flowing in divergent directions in a primary mixing chamber 80. Primary mixing chamber 80 is interiorly formed in the insulated conduit 32 essentially between concave screen 50 and planar screen 60. During the period of time that the dispersed gases are in the mixing chamber 80, the unconsumed oxygen and the exhaust gases are recombined and intermixed to form a more homogeneous exhaust stream mixture which is vertically propelled in an upward direction.

The intermixed exhaust stream encounters planar screen 60 having a plurality of apertures 62 which essentially function as restricted orifices. The passing of the exhaust gas stream through apertures 62 results in increased turbulence and an accelerated exiting exhaust gas stream. The accelerated gas stream impinges against the randomly oriented flaps 64 which results in a rapid increase in the turbulence and mixing of the exhaust stream. A secondary combustion chamber 90 is formed in conduit 32 in the vicinity of planar screen 60 and flaps 64. Under suitable conditions, a secondary flame front forms on the downstream side of planar screen 60 in the secondary combustion chamber 90. The exhaust stream from the secondary combustion at the flame front is relatively clean and eventually exits via exhaust plenum 34 and plenum 21 to the exhaust flue 22 in the general direction indicated by the arrows in FIG. 1.

A temperature probe 70 may be located in the secondary combustion chamber 90 for detecting the temperature and adjusting air inlets to the firebox in accordance with the temperatures detected. A suitable probe is the VT Group High Temp Probe marketed by Vermont Technology Group, Inc. It should be noted that the conduit 32 is insulated to retain the high temperatures of the exhaust gases within the conduit so that the exhaust stream is essentially dispersed, intermixed, accelerated, imparted with turbulence, and secondarily combusted in a substantially thermally isolated environment. The conduit is also substantially air tight so that a secondary flame front is produced without the introduction of a secondary oxygen supply into the exhaust stream.

The intake opening 38 is dimensioned to provide a relatively restricted opening in relation to the firebox chamber 18 so that a relatively high velocity exhaust stream exits into the secondary combustion system. For example, in a preferred stove embodiment wherein the firebox chamber has dimensions on the order of 18 in. by 10 in. by 13 in., the intake opening 38 has an opening area of approximately 14 square in. Similarly, in order to maintain the relative high velocity of the exhaust stream, the insulated passageway formed by conduit 32 and insulation layer 40 is a relatively narrow passageway having a uniform cross sectional area which is approximately equal to the area of the intake opening. In the latter embodiment, the planar screen 60 is vertically spaced approximately 6 inches from the bottom of the transverse passageway on the lower edge of concave screen 50 to allow sufficient time in mixing chamber 80 for the exhaust gases and the uncombusted oxygen to thoroughly mix.

In preliminary tests employing the foregoing described secondary combustion system wherein the exhaust gases within the firebox were between 700° F. and 1100° F., the exhaust gas temperatures in mixing chamber 80 were on the order of 1100° F. due to the presence of insulation in the chamber. Under such conditions, a secondary flame front was formed at the downstream side of screen 60. Temperatures between 1600° F. and 1900° F. were detected by a high temperature probe 70 which was located in the secondary combustion chamber 90. At a location approximately four feet up into the exhaust flue, the temperatures of relatively clean exhaust gases were measured at approximately 450° F. The oxygen content of the flue exhaust gases was as low as 5 percent. The flue exhaust gas stream also had a carbon dioxide content on the order of 16 percent and a carbon monoxide content on the order of 0.5 percent.

The foregoing description of a secondary combustion system for a woodburning stove has been set forth for purposes of illustration and should not be deemed a limitation of the invention herein. Accordingly, various modifications, adaptations, and alternatives may occur to one skilled in the art without departing from the spirit and scope of the present invention.

What is claimed is:

1. An improved secondary combustion system for combusting the exhaust gases in a woodburning stove comprising:

an insulated conduit defining an exhaust passageway and having an intake opening and an exit opening;

dispersion means defining a plurality of apertures interposed across said passageway in the vicinity of the intake opening to disperse exhaust gases injected through the intake opening;

a primary mixing chamber formed in the exhaust passageway for mixing the dispersed exhaust gases;

restriction means defining a plurality of apertures interposed across said passageway and spaced from said dispersion means to increase the exhaust velocity and turbulence of the exhaust gases;

turbulence means to increase the turbulence in the exhaust gases exiting the restriction means; and a secondary combustion chamber formed in the exhaust passageway between the restriction means and the exit opening for combusting the exhaust gases.

2. The combustion system of claim 1 wherein the dispersion means is a generally concave shaped screen.

3. The combustion system of claim 1 wherein the restriction means is a substantially planar screen extending generally transversely across the exhaust passageway.

4. The combustion system of claim 3 wherein the screen is a metallic sheet which is perforated to form apertures in a manner wherein perforated flap portions extend at an angle to the screen, the turbulence means being the flap portions.

5. The combustion system of claim 4 wherein the flap portions are angularly oriented to form a generally random array of flaps extending from the plane of the screen.

6. The combustion system of claim 1 wherein the dispersion means apertures are substantially uniformly dimensioned and uniformly distributed.

7. The combustion system of claim 1 wherein the restriction means apertures are substantially uniformly dimensioned and uniformly distributed.

8. The combustion system of claim 1 wherein the exhaust passageway has a longitudinally extending segment and a transversely extending segment, the dispersion means being located in the transverse segment.

9. An improved woodburning stove adaptable for combusting exhaust gases comprising:

a firebox chamber;

an exhaust plenum means communicating with the firebox chamber and adapted for connecting with an exhaust flue;

an insulated passageway having an intake opening leading from said firebox chamber and an exit opening leading to the exhaust plenum means;

a generally concave shaped screen defining a plurality of apertures interposed across said passageway in the vicinity of the intake opening;

a generally planar screen spaced from said concave screen and interposed across said insulated passageway, said planar screen forming a plurality of apertures; and an array of generally randomly oriented flaps located in the passageway and extending at an angle to the planar screen.

10. The stove of claim 9 wherein the insulated passageway includes a generally vertically extending portion and a transversely extending portion terminating at the intake opening.

11. The stove of claim 10 wherein the concave screen extends inwardly into the transverse portion.

12. The stove of claim 11 wherein the concave screen is formed from stainless steel and the apertures are substantially uniformly dimensioned and uniformly distributed in the screen.

13. The stove of claim 10 wherein the planar screen is located at an intermediate vertical position of said vertical portion and extends transversely across the insulated passageway to form a lower mixing chamber and an upper secondary combustion chamber.

14. The stove of claim 13 wherein the planar screen is formed from a sheet of metal by perforating the sheet to form apertures and bending the aperture perforate portions to form said flaps.

15. The stove of claim 13 further comprising a high temperature probe extending into said secondary combustion chamber.

16. The stove of claim 10 wherein the exhaust plenum means extends generally transversely from said insulated passageway.

17. A method for removing pollutants from an exiting exhaust stream of unconsumed oxygen and exhaust gases produced by the combustion of combustibles in a woodburning stove comprising:

(a) dispersing the exhaust stream into a plurality of small stream segments flowing in divergent directions;

(b) recombining and intermixing the stream segments to form a more homogeneous mixture of the unconsumed oxygen and the exhaust gases;

(c) restricting the exiting of the exhaust stream downstream of the intermixing thereby accelerating the gas stream;

(d) imparting a turbulence to the accelerated gas stream thereby combusting the exhaust gases in the presence of the unconsumed oxygen.

18. The method of claim 17 wherein steps (a)–(d) are performed in a substantially thermally isolated environment.

19. The method of claim 17 wherein steps (c) and (d) are performed in close proximity to facilitate the combusting of the exhaust gases.

20. The method of claim 17 wherein the steps (a)–(d) are performed without the introduction of a secondary supply of oxygen.

* * * * *